US005111801A

United States Patent [19]

Katoh

[11] Patent Number: 5,111,801

[45] Date of Patent: May 12, 1992

[54] APPARATUS FOR FORMING SLIT IN ROCK AND CONCRETE SURFACE

[76] Inventor: Yutaka Katoh, 1853, Kokufuhongoh, Oiso-machi, Naka-gun, Kanagawa-ken 259-01, Japan

[21] Appl. No.: 543,832

[22] PCT Filed: Jun. 27, 1988

[86] PCT No.: PCT/JP88/00643

§ 371 Date: Jul. 12, 1990

§ 102(e) Date: Jul. 12, 1990

[87] PCT Pub. No.: WO89/06741

PCT Pub. Date: Jul. 27, 1989

[30] Foreign Application Priority Data

Jan. 14, 1988 [JP] Japan ..... 63-4942

[51] Int. Cl.[5] ..... E21B 6/00

[52] U.S. Cl. ..... 125/23.01; 173/50; 173/51; 175/108

[58] Field of Search ..... 125/23.01, 19, 40; 173/50, 51; 175/108; 299/70

[56] References Cited

U.S. PATENT DOCUMENTS 282,382 7/1883 Shedlock ..... 173/51
640,621 1/1900 Bailey ..... 173/50
2,683,021 7/1954 Braver ..... 173/50
3,612,193 10/1971 Hirata ..... 175/108
4,681,170 7/1987 Ohi ..... 173/50

FOREIGN PATENT DOCUMENTS 35-16826 11/1960 Japan .
61-95198 5/1986 Japan .

*Primary Examiner*—Robert Rose

[57] ABSTRACT

An apparatus for forming a slit in a rock and a concrete surface has a simple construction to enable a deep slit having a predetermined width and smooth inner surface to be made efficiently and also decreases the slit making cost due to replacement of bits. This slit forming apparatus comprises a plate type bit (17) fixedly secured to the leading end of a laterally swingable plate (13), a drill bit (11) fixedly mounted on the leading end of a rod (9*a* and/or 9*b*), which is disposed along at least one side of the plate, so that it may rotate and slide, and striking means (5 and/or 12*a*, 12*b*) for striking the plate and the rod simultaneously or separately. Further, the rod has at its front end portion a stabilizer for stabilizing the direction of sliding. The plate type bit consists of a plurality of detachable bit blocks.

11 Claims, 11 Drawing Sheets

APPARATUS FOR FORMING SLIT IN ROCK AND CONCRETE SURFACE

TECHNICAL FIELD OF THE INVENTION

This invention relates to an apparatus for making a slit shaped hole in a rock and a concrete surface, and more particularly to an apparatus for forming a slit in a rock and a concrete surface, which is provided with a swingable plate type bit having cutting edge portions mounted on the leading end thereof.

BACKGROUND ART OF THE INVENTION

In a prior art apparatus of the kind specified above for forming a slit in a rock and a concrete surface, such as the one disclosed in Japanese Laid-Open Patent Application No. SHO 60-5996, an apparatus for making a plurality of holes uses a plurality of drills. Further, a method of continuously making holes in partially overlapped relationship is disclosed in Japanese Laid-Open Patent Application No. SHO 61-31591.

While it has been expected to develop an apparatus for forming a slit efficiently in a rock and a concrete surface, the above-mentioned prior apparatus and method have posed the following problems.

(1) A low drilling speed.

(2) A complicated construction.

(3) Because interconnected slits are formed, irregularities remain in the inner surfaces of the slits.

SUMMARY OF THE INVENTION

The present invention has been made in view of the above-mentioned circumstances in the prior art, and has for its object to provide an apparatus for forming a slit in a rock and a concrete surface, which has a simple construction to enable a slit or hole having a predetermined width and a smooth inner surface to be made efficiently.

Another object of the present invention is to provide an apparatus for forming a slit in a rock and a concrete surface, which has a simple construction to enable a deep slit having a predetermined width and a smooth surface to be made efficiently.

A further object of the present invention is to provide an apparatus for forming a slit in a rock and a concrete surface, arranged such that increase in boring cost due to frequent replacement of bits can be suppressed.

To achieve the above-mentioned objects, according to a first aspect of the present invention there is provided an apparatus for forming a slit in a rock and a concrete surface comprising a frame supported in such a manner that it may be turned freely in the vertical direction; a sliding base mounted on the frame in such a manner that it may be slidably moved in the longitudinal direction thereof; a striking means fixedly secured onto the sliding base and having an actuating shaft; a striking plate extending forwardly along the frame and fixedly secured to the leading end of the shaft; two lengths of longitudinally extending rods spaced apart widthwise of the frame and in parallel with each other, each of the rods having one drill bit mounted on the leading end thereof; a first support base fixedly secured to the front end portion of the frame so as to support the portions of these rods near the leading ends thereof such that they may be slidably moved forwardly in the longitudinal direction of the frame; a second rod supporting means fixedly mounted on the sliding base and adapted to slidably support the portions of these rods near the base or trailing ends thereof so as to allow the base ends of the two lengths of rods to contact the contact surface of the striking plate; a plate having a plate type bit mounted on the leading end thereof, the plate being located in between the two lengths of rods such that the plate type bit is disposed somewhat behind the drill bits when not in use and the base end of the plate is kept into contact with the contact surface of the striking plate; and a plate swinging means for swinging the plate widthwise of the frame.

According to a second aspect of the present invention, there is provided an apparatus for forming a slit in rock or a concrete surface, characterized in that the plate type bit as set forth in the first aspect has cutting edge portions mounted on the leading end thereof.

Further, according to a third aspect of the present invention, there is provided an apparatus for forming a slit in a rock and a concrete surface, characterized in that the plate type bit as set forth in the first aspect consists of a plurality of individually detachable bit blocks.

According to a fourth aspect of the present invention, there is provided an apparatus for forming a slit in a rock and a concrete surface, characterized in that the second rod supporting means as set forth in the first aspect comprises two sets of rotating•striking means for striking the two lengths of rods while rotating them above their respective axes.

According to a fifth aspect of the present invention, there is provided an apparatus for forming a slit in a rock and a concrete surface, characterized in that the plate swinging means as set forth in the first aspect comprises a swinging support base mounted on one side of the sliding base and adapted to support the plate so as to slidably move it by a predetermined stroke in the longitudinal direction thereof; and two sets of piston• cylinder units having piston rods capable of extension and contraction and connected between both sides of the swinging support base and both sides of the sliding base so as to swing the plate widthwise of the frame about a fulcrum of swing located substantially at the center of the swinging support base.

According to a sixth aspect of the present invention, there is provided an apparatus for forming a slit in a rock and a concrete surface, characterized in that the rear end face of the plate and the contact surface of the striking plate which contacts the rear end face are of a circular arc shape whose center is located at the fulcrum of swing of the swinging support base.

Further, according to a seventh aspect of the present invention, there is provided an apparatus for forming a slit in a rock and a concrete surface, characterized in that the plate swinging means comprises a swinging support base mounted on one side of the sliding base and adapted to support the plate so as to slidably move it by a predetermined stroke in the longitudinal direction thereof; a swing arm whose one side is fixedly secured to the swinging support base and whose other side extends to the approximately intermediate portion of the sliding base; and one set of double-acting piston• cylinder unit mounted on the approximately intermediate part of the sliding base and connected to the other side of the swing arm so as to swing the plate widthwise of the frame about the fulcrum of swing located substantially at the center of the swinging support base.

Further, according to a ninth aspect of the present invention, there is provided an apparatus for forming a slit in a rock and a concrete surface, characterized in that the plate swinging means as set forth in the first aspect comprises a first holder adapted to support the plate on the front end side of the frame in such a manner that the plate may be slidably moved in the longitudinal direction thereof; a second holder adapted to support the plate on one side of the sliding base in such a manner that the plate may be slidably moved in the longitudinal direction thereof; a first double-acting piston•cylinder unit fixedly mounted on the frame at a position corresponding to the first holder and connected to both sides of the first holder so as to swing the first holder widthwise of the frame; and a second double-acting piston•cylinder unit fixedly mounted on the sliding base and connected to both sides of the second holder so as to swing the second holder widthwise of the frame.

Still further, according to a tenth aspect of the present invention, there is provided an apparatus for forming a slit in a rock and a concrete surface, characterized in that it further comprises a stabilizer disposed between the drill rods mounted on the leading ends of the two lengths of longitudinally extending rods, respectively, and the first support base as set forth in the first aspect, and adapted to support the two lengths of rods in such a manner that they may be slidably moved in the longitudinal direction thereof.

And, according to an eleventh aspect of the present invention, there is provided an apparatus for forming a slit in a rock and a concrete surface, characterized in that the stabilizer as set forth in the tenth aspect is configured to pass the plate therethrough, and a piece of pin projecting vertically upwards and downwards from the plate is engaged with a hole formed in the central part of the stabilizer so as to connect the plate to the stabilizer so that they may be slidably moved in synchronism with each other.

DETAILED DESCRIPTION OF PREFERRED EMBODIMENTS

Figure 1:
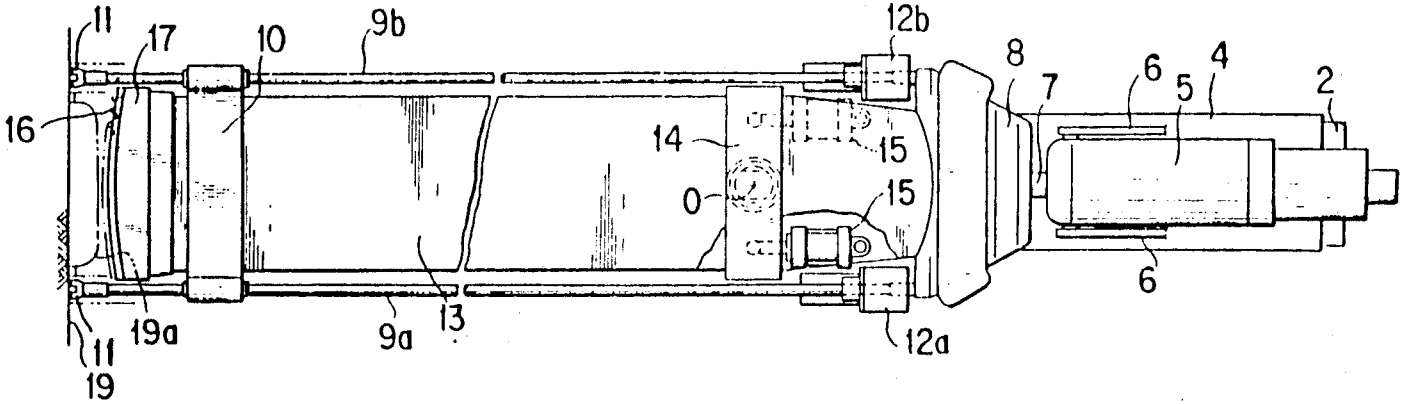
FIGS. 1 and 2 are a schematic plan view and a schematic side elevational view, respectively, showing a first embodiment of the present invention in shorter length than actual.
Figure 2:
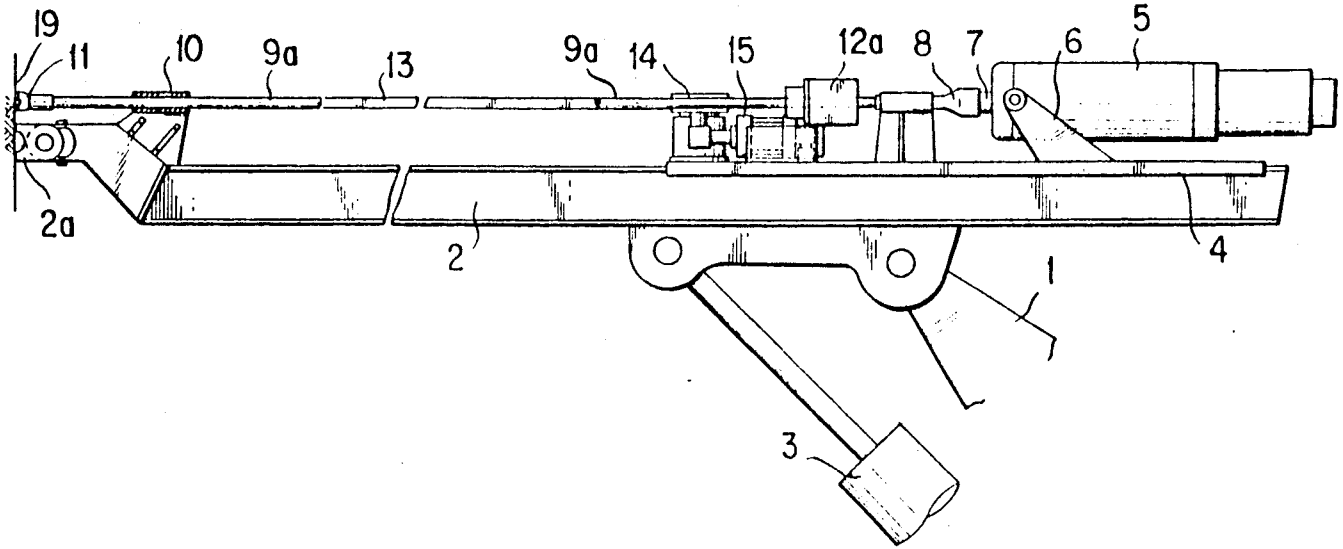

In the first place, a first embodiment of the present invention will be described below with reference to FIGS. 1 and 2.

In the drawings, reference numeral 1 denotes an arm; 2 a frame supported on the leading end of the frame 1 in such a manner that it may be turned freely in the vertical direction; and 3 a piston•cylinder unit for turning the frame 2. Reference numeral 4 denotes a sliding base mounted slidably on the upper surface of the frame 2. This sliding base is arranged to be moved back and forth along the frame 2 by a driver means not shown. Reference numeral 5 indicates a striking means supported through brackets 6 on the sliding base 4, and 7 an actuating shaft thereof. Reference numeral 8 indicates a striking plate mounted on the actuating shaft, which is longer widthwise and whose central part is connected to the above-mentioned actuating shaft 7. Reference numerals 9*a*, 9*b* indicate rods which are spaced apart in the transverse direction and are disposed longitudinally in parallel with each other and also with the frame 2. The leading ends of the rods 9*a*, 9*b* are axially slidably supported by a supporting base 10 fixedly mounted on the frame 2. The rods 9*a* and 9*b* have drill bits 11 fixedly secured to the leading ends thereof. The bases on trailing ends of the rods 9*a*, 9*b* extend through rotating means 12*a* and 12*b* and are brought into contact with both sides of the above-mentioned striking plate 8. Reference numeral 13 denotes a plate which is disposed between the rods 9*a* and 9*b*. The leading end portion of the plate 13 is supported by the above-mentioned supporting base 10 in such a way as to slide freely widthwise and lengthwise of the frame 2. The base or trailing end of the plate 13 is supported by a swinging support base 14 in such a manner that the plate may slide a predetermined stroke in the longitudinal direction. Further, the rear end face of the plate 13 is brought into contact with the front end face of the striking plate 8 of the striker means 5. The above-mentioned swinging support base 14 is supported on the sliding base 4 in such a way as to freely swing in the horizontal direction (widthwise of the frame 2). Both sides of the swinging support base 14 are connected through piston•cylinder units 15 to the sliding holder 4. The contact faces of the plate 13 and the striking plate 8 are of circular-arc shape whose center is located at the fulcrum of swing of the swinging support base 14. Fixedly secured to the front end of the plate 13 is a plate type bit 17 having built-in carbide tips 16. The plate type bit 17 is located somewhat behind the above-mentioned drill bits 11 when not in use.

Figure 8:
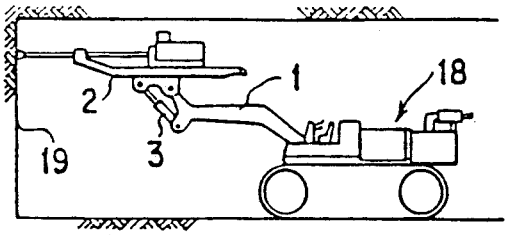
FIG. 8 is a schematic side elevational view showing operating condition of each embodiment of the present invention.

The frame 1 supporting the frame 2 is mounted on a construction vehicle 18 in such a manner that it may be raised and lowered as shown in FIG. 8.

The frame 2 is provided at the construction vehicle's front end with a supporting pawl 2*a* adapted for thrusting into a rock 19 and is fixedly secured to the frame itself when it is pressed against the rock.

In the above-mentioned configuration, when the striking means 5 and the rotating means 12*a*, 12*b* are actuated, the drill bits 9*a*, 9*b* are struck by the striking plate 8 so that they may be subjected to striking forces while they are being rotated by rotating means 12*a*, 12*b*. Further, the plate type bit 17 is also subjected to striking forces applied by the striking plate 8. Furthermore, the plate type bit 17 is swung horizontally about the fulcrum of swing O through the swinging support base 14 and between the drill bits 9*a* and 9*b* when the piston•cylinder units 15 are rendered operative. Further, the above-mentioned drill bits 9*a*, 9*b* and the plate type bit 17 are moved back and forth by the sliding holder 4 along the frame 2.

Rock excavating operations by using the above-mentioned apparatus will be described below.

As shown in FIG. 8, the construction vehicle 18 is moved forward, and the arm 1 and the frame 2 are raised or lowered so as to allow the leading ends of the drill bits 11 to thrust against the rock 19 approximately at right angles thereto, and then the rotating means 12*a*, 12*b* and the striking means 5 are actuated. As a result, the drill bits 11 are subjected to striking forces while they are being rotated so that the rock 19 may be crushed or excavated. By advancing the sliding base 4 simultaneously with the above operation, two horizontally spaced-apart holes are made by the two drill bits 11. When the holes are formed by the drill bits 11 to a certain depth in the rock, the leading end of the plate type bit 17 will strike against rock 19*a* between the aforementioned two holes. When the plate type bit 17 strikes against the rock 19*a*, it is swung widthwise (or horizontally) of the frame 2 and is applied with striking forces produced by the striking plate 8, thereby crushing the rock 19*a* between the two holes.

As a result of the above-mentioned operations, a slit having a length corresponding to the spacing between the drill bits 11 is formed in the rock 19.

FIGS. 3 to 7 show second and third embodiments of the present invention. Since the component parts thereof denoted by the same reference numerals as those used in FIGS. 1 and 2 are the same elements having the same functions, the description of them is omitted herein to avoid duplication of explanation.

The second and third embodiments differ from the first embodiment in the construction of the plate swinging means.

Figure 3:
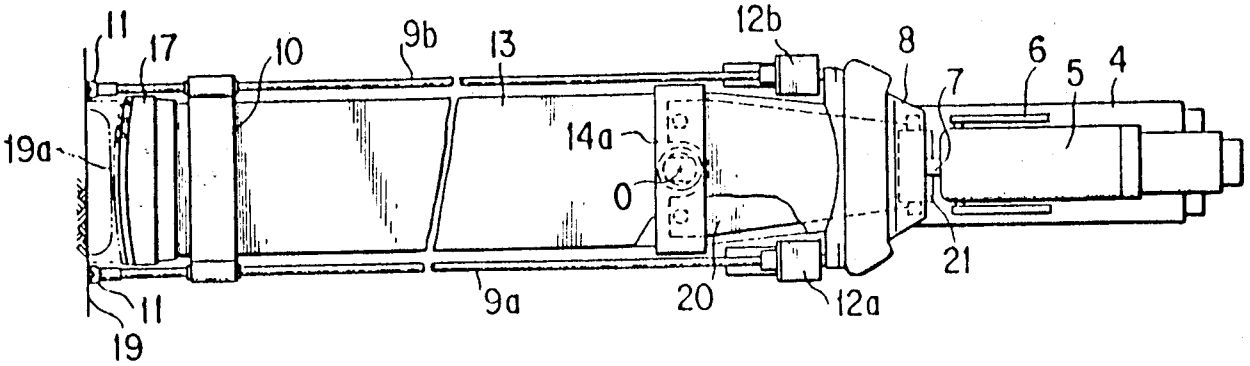
FIGS. 3 and 4 are a schematic plan view and a schematic side elevational view, respectively, showing a second embodiment of the present invention in shorter length than actual.
Figure 4:
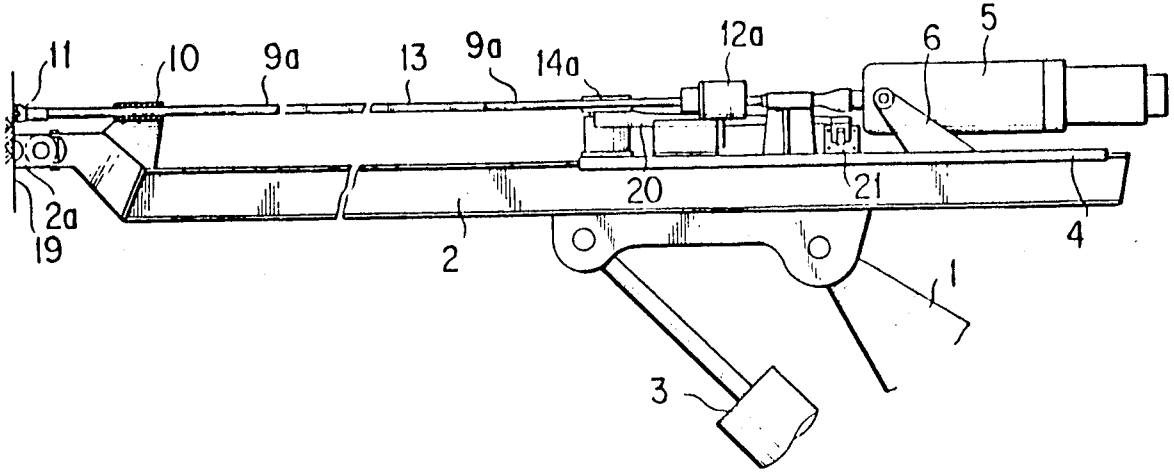

The second embodiment, shown in FIGS. 3 and 4, is constructed such that a swing arm 20 is fixedly secured to a swinging support base 14*a*, and a double-acting piston•cylinder means 21 mounted on the sliding base 14 is connected to the leading end of the swing arm 20. The arrangement is made such that when the double-acting piston•cylinder unit 21 is actuated, the swinging support base 14 may be swung horizontally and widthwise of the frame 2.

Figure 5:
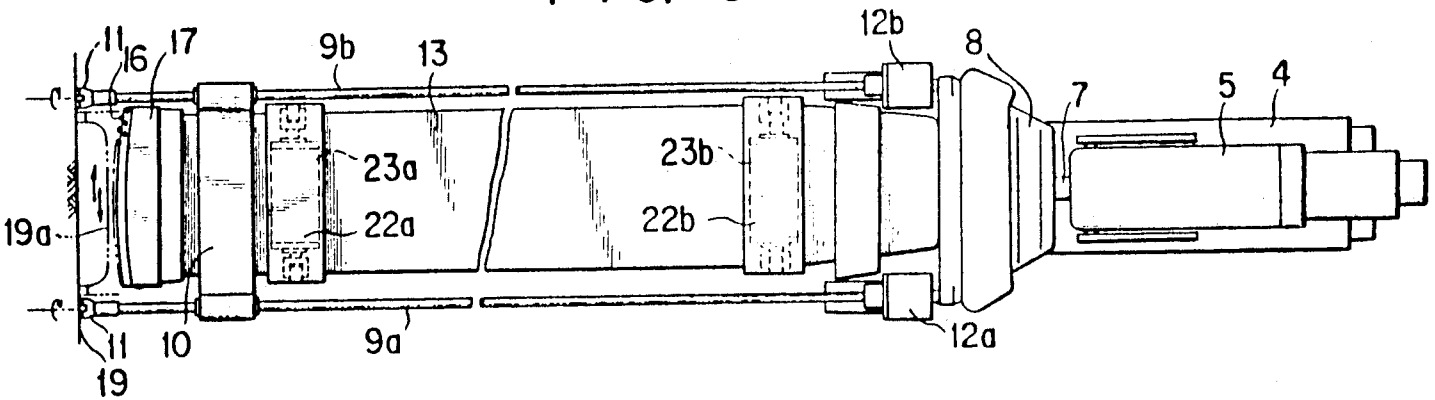
FIGS. 5 and 6 are a schematic plan view and a schematic side elevational view, respectively, showing a third embodiment of the present invention in shorter length than actual.
Figure 6:
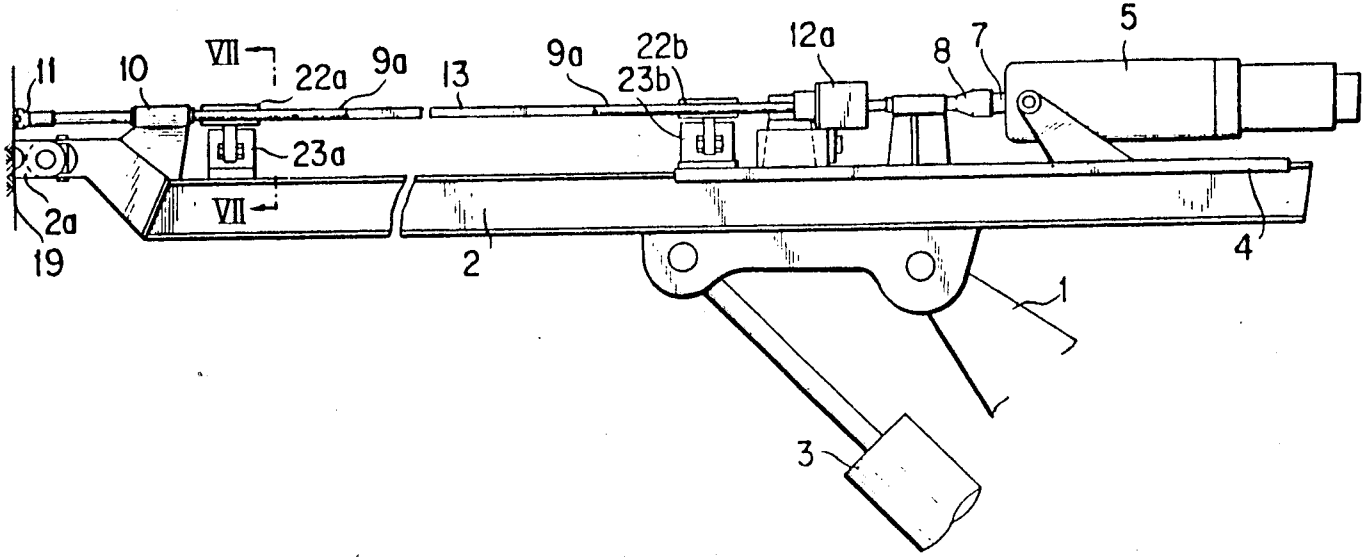
Figure 7:
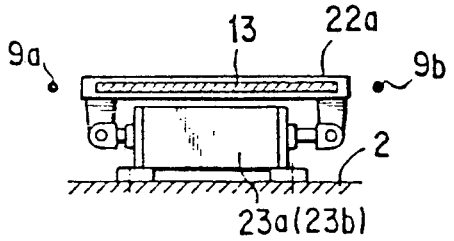
FIG. 7 is a sectional view taken along line VII—VII in FIG. 6.

The third embodiment shown in FIGS. 5, 6 and 7 is constructed such that a plate 13, having a plate type bit 17 fixedly secured to the leading end thereof, is supported at its front and rear portions by a first holder 22*a* and a second holder 22*b*, respectively, as so to freely slide in the longitudinal direction of the frame 2. The front holder 22*a* and the rear holder 22*b* are mounted through a first double-acting piston•cylinder unit 23*a* and a second double-acting piston•cylinder unit 23*b*, respectively, on the frame 2 and the sliding base 4, respectively. This allows the front and rear holders 22*a* and 22*b* to be moved by their associated piston•cylinder units widthwise of the frame 2. In this embodiment, the contact faces of the plate 13 and the striking plate 8*a* are kept in parallel with the direction of movement of the plate 13.

Figure 9:
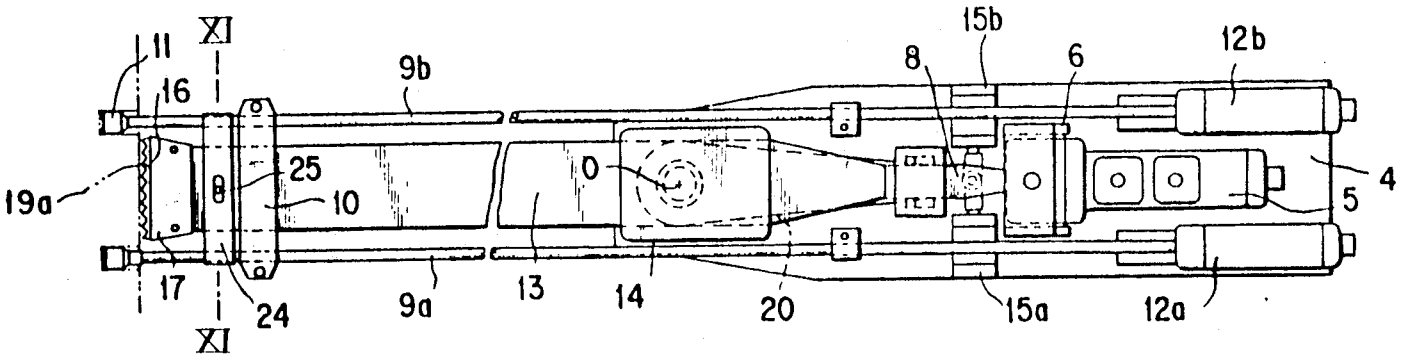
FIGS. 9 and 10 are a schematic plan view and a schematic side elevational view, respectively, showing a fourth embodiment of the present invention in shorter length than actual.
Figure 10:
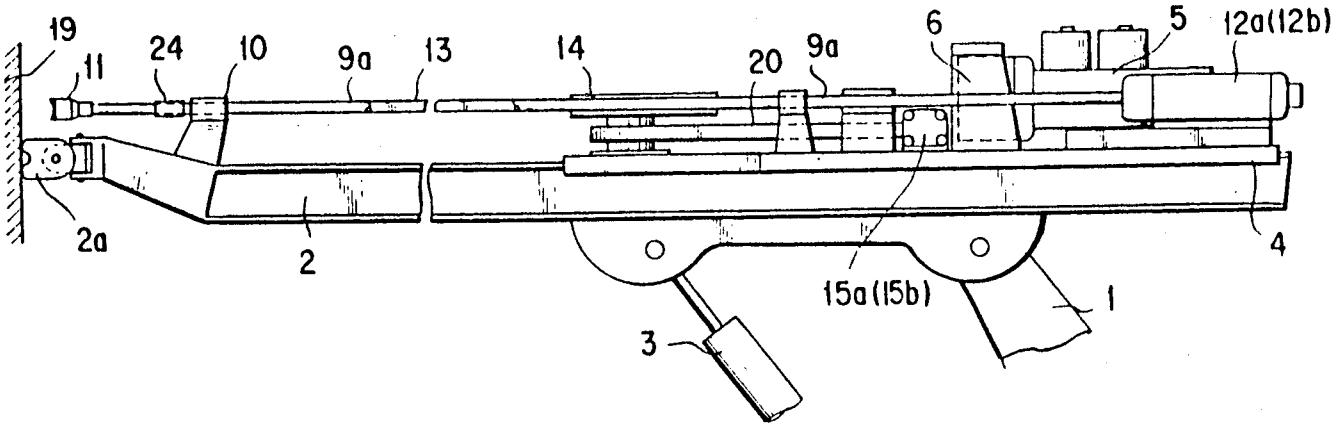

Next, the fourth embodiment of the present invention will be described with reference to FIGS. 9 to 11.

In this fourth embodiment too, the component parts thereof indicated by the same reference numerals and characters as those used in the first, second and third embodiments are the same elements having the same functions. Therefore the description of them is omitted herein to avoid duplication of explanation.

In this fourth embodiment, rods 9*a* and 9*b*, which have drill bits 11, mounted on the leading ends thereof, are disposed on both sides of the plate 13 and have their base or trailing ends thereof connected to their respective rotating•striking means 12*a*, 12*b*, respectively. The rear end face of the plate 13, having a plate-type pit 17 at the leading end thereof, is brought into contact with the leading end face of a striking plate 8 of a striking means 5, as in the above-mentioned embodiments. Thus, the drill bits 11 and the plate type bit 17, may be struck independently. As a result, excellent transmission of striking forces to the drill bits 11 can be achieved so that the boring operation can be made smoothly. With regard to the plate type bit 17, the striking plate 8 can be made smaller in size and lighter in weight so that the size of the striking force transmitting member can be made smaller.

Further, in this fourth embodiment, a stabilizer 24 is mounted on the drill bits 9*a*, 9*b*, in front of a support base 10, which supports the leading end portions of the plate 13 and the rods 9*a*, 9*b*, respectively. The stabilizer is placed between the support base 10 and the plate type bit 17, in order to keep the distance between the rods 9*a* and 9*b* constant.

Figure 11:
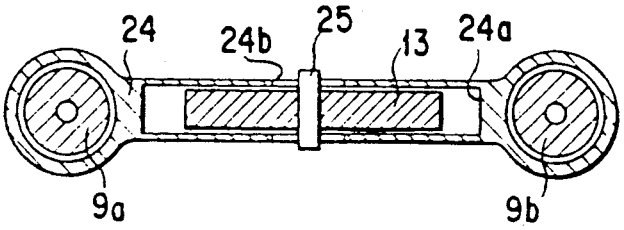
FIG. 11 is a sectional view taken along line XI—XI in FIG. 9.

As shown in FIG. 11, the stabilizer 24 slides on the rods 9*a* and 9*b* and has the following operational relationship with the plate 13. Hereupon, the stabilizer 24 has a hollow portion 24*a* which is formed in the intermediate portion thereof and through which the plate 13 can freely slide in the direction of swing thereof. Further, since a pin 25 projecting vertically up and down from the plate 13 engages with the edges of the minor axis of an elliptical hole 24*b* formed through the stabilizer 24. When the plate 13 is moved in the longitudinal direction thereof, the stabilizer 24 slides along the rods 9*a*, 9*b*, with the plate 13.

Figure 12:
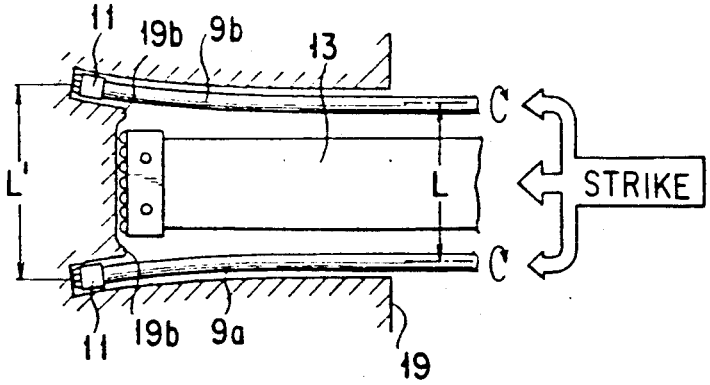
FIGS. 12 and 13 are explanatory views showing conditions of two lengths of drill rods when holes are made by drill bits according to prior art arrangement and the present invention, respectively.

In a slit forming operation, as the slit becomes deeper, the drill rods 9*a*, 9*b* are thrust further from the support base 10, and as a result, the leading end side portions of the drill rods 9*a*, 9*b* become unstable. Thus when the drill bits 11 are subjected to unequal loads, due to formation of cracks in the rock 19 and uneven quality thereof, the spacing L' between the leading ends of the drill rods 9*a* and 9*b* may become wider than the normal spacing L, as shown in FIG. 12. This renders it impossible to keep the normal spacing L. In such a case, the spacing between the two holes made by the drill bits 11 becomes wider than the excavation width of the hole made by the plate type bit 17 thus leaving portions 19*b*, 19*b* which are not. This creates discontinuity between the left and right holes and the central hole which may render it impossible to make an intended hole.

Figure 13:
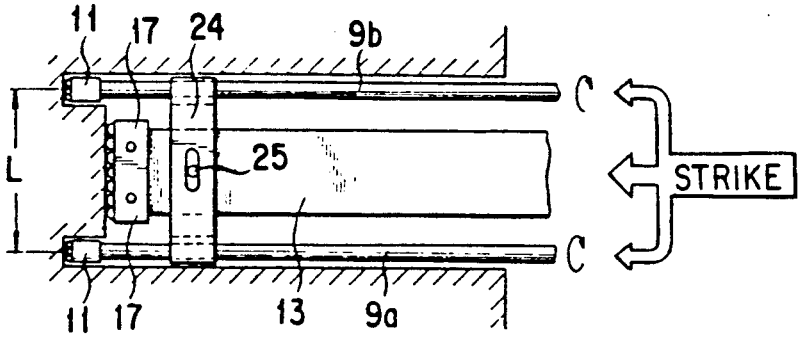

Thereupon, in the fourth embodiment, as the slit being formed becomes deeper and the sliding base is moved forward so that the drill rods 9*a*, 9*b* and the plate 13 are thrust away from the support base 10, the stabilizer 24 is also moved away at the same time. As a result, as shown in FIG. 13, the drill bits 9*a* and 9*b* are always supported by the stabilizer 24 at the same positions from the drill bits 11. Therefore, even when the depth of the hole becomes deeper, the spacing between the drill bits 11 can always be maintained at the normal value L regardless of excavating conditions.

Further, it is desirable to make the sectional area of the striking plate 8 equal to that of the piston for the striking means 5. It is difficult, however, achieve this in practice.

We have made experimental studies and the results are summarized as follows.

Figure 14:
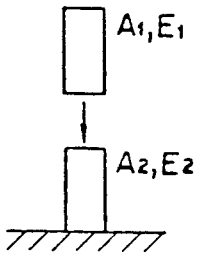
FIGS. 14 and 15 are explanatory views showing the relationship between the sectional area of the piston at the striking force transmitting portion and the striking energy.
Figure 15:
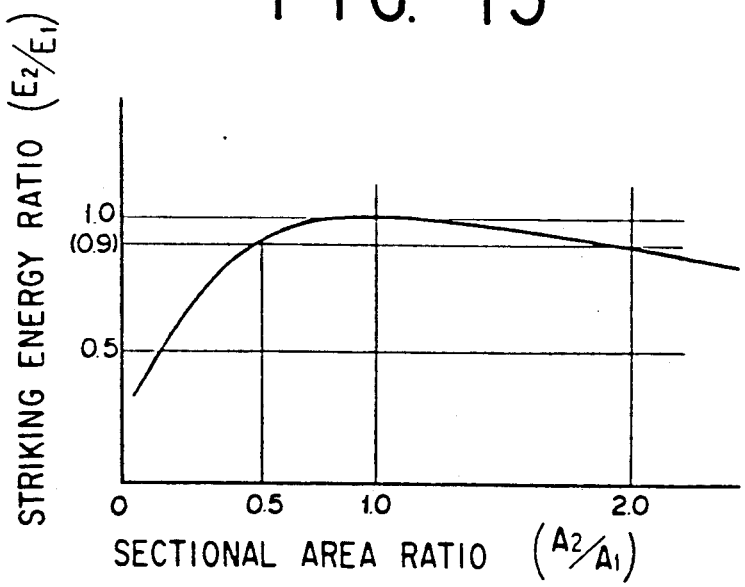

It was found out that if the ratio of sectional area between the striking plate 8 and the piston of the striking means is in the range of 0.5 to 2.0, then about 90% or more of the kinetic energy, or the striking energy, produced by the piston in the striking means 5 can be transmitted to the striking plate 8. FIGS. 14 and 15 show the above-mentioned experimental result wherein $A_1$ denotes the area of the piston, $A_2$ the area of the striking energy transmitting member, $E_1$ the kinetic energy developed by the piston, and $E_2$ the kinetic energy of the striking energy transmitting member. With a higher energy transmission ratio ($E_2/E$), more of the striking energy is transmitted.

Figure 16:
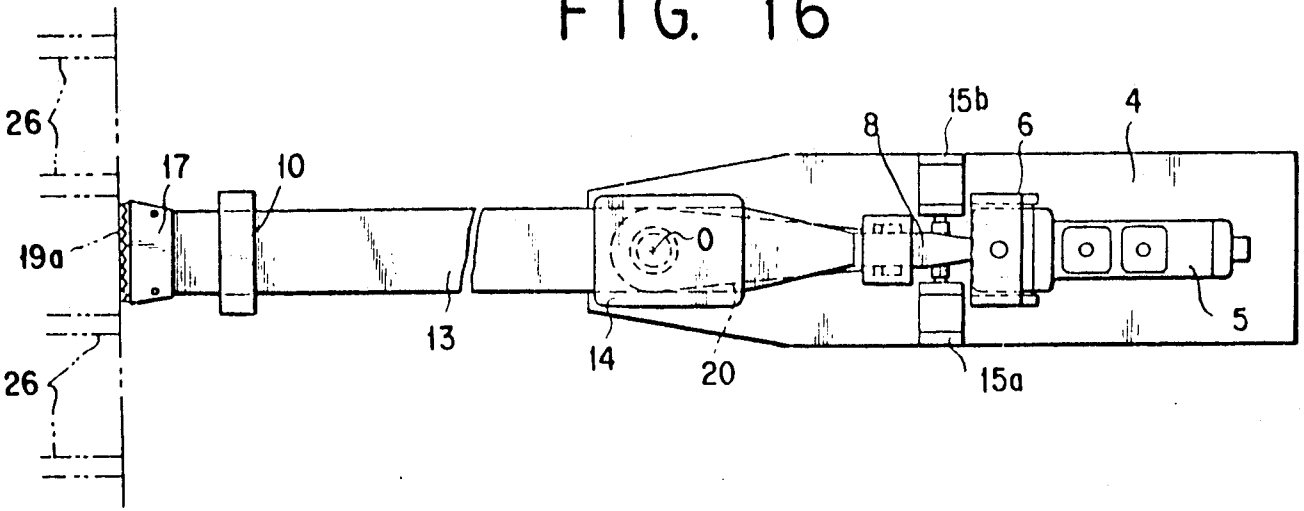
FIGS. 16 and 17 are a schematic plan view and a schematic side elevational view, respectively, showing a fifth embodiment of the present invention in shorter length than actual.
Figure 17:
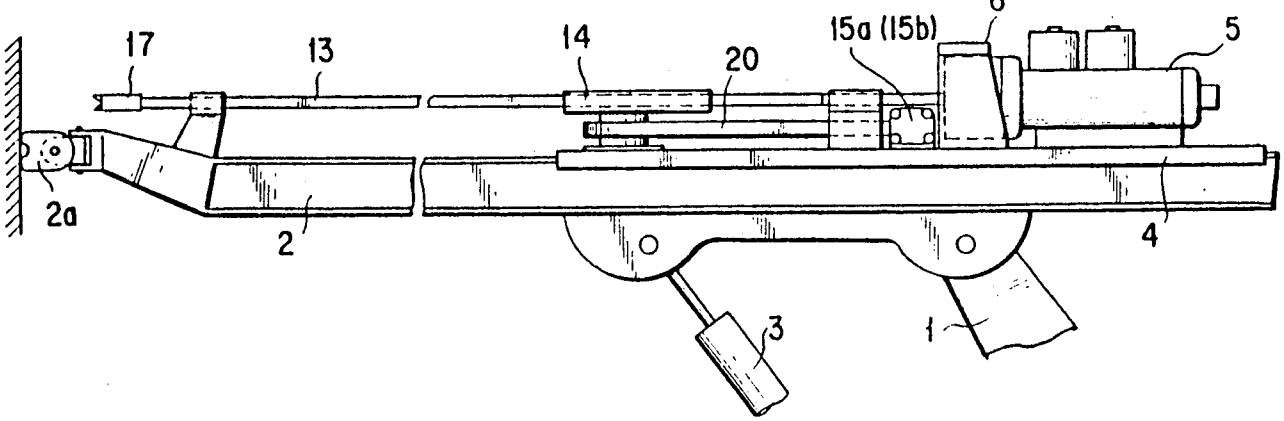

FIGS. 16 and 17 show the fifth embodiment which is a modification of the fourth embodiment.

Reference numerals 26 indicate a plurality of holes made previously in rows at regular intervals in a rock by means of a boring device not shown. These drawings show an apparatus for use in forming a slit between the adjoining holes. In this slit forming apparatus, the provision of drill bits is not necessary and desired slits can be formed only by the plate type bit alone. Further, it is possible to form interconnected slits.

Figure 18:
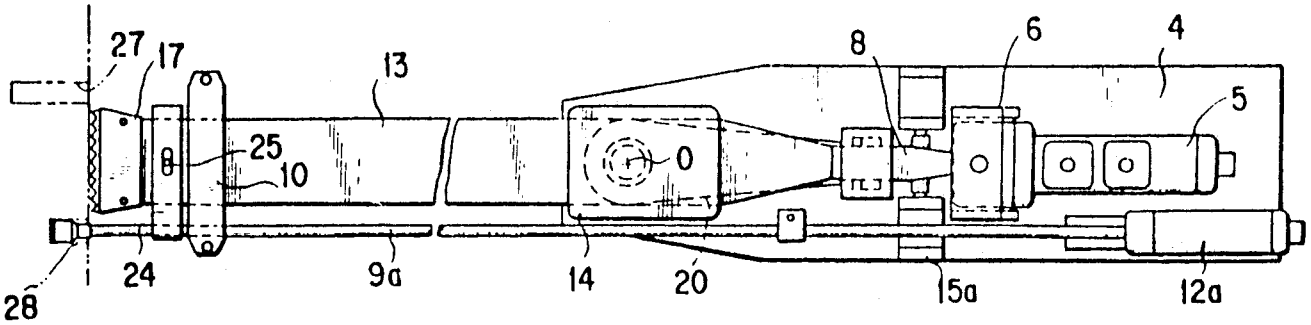
FIGS. 18 and 19 are a schematic plan view and a schematic side elevational view, respectively, showing a sixth embodiment of the present invention in shorter length than actual.
Figure 19:
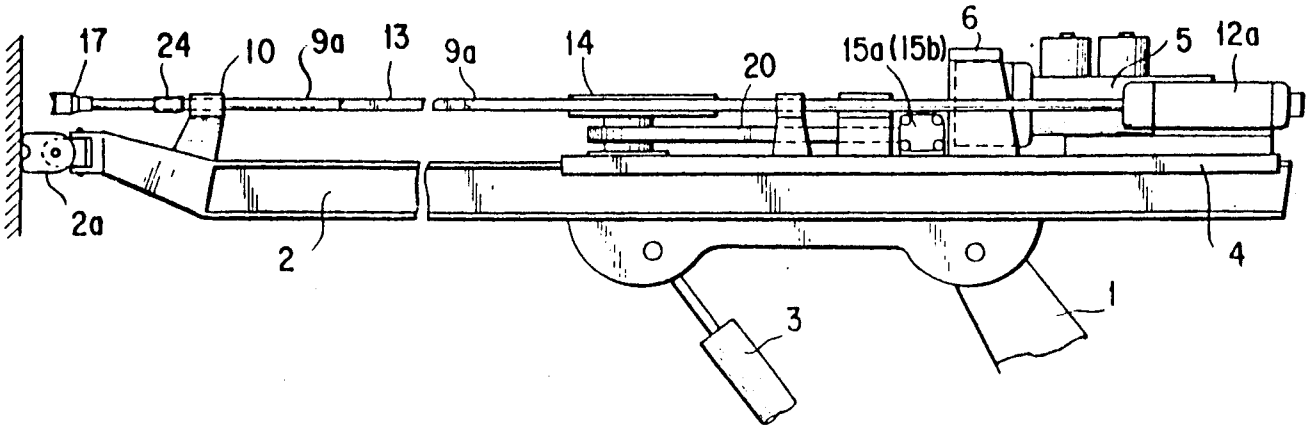

FIGS. 18 and 19 show a further modification of the above-mentioned fourth embodiment.

This modified embodiment comprises a striking means 5 for drilling the portion of a rock between previously made holes and a rotating•striking means 12*a* for use with a piece of drill rod 9*a*.

An interconnected slit forming operation using this modified embodiment is made as follows.

A preliminary hole 27, which serves as the starting point, is made by means of a boring device, not shown, and then a second hole 28 is made by the drill rod 9*a* at a position spaced from the hole 27 by a distance which is nearly equal to the transverse width of the plate type bit 17. Thereafter, the rock or concrete surface between the holes 27 and 28 is crushed by the plate type bit 17 to form a slit. In case interconnected slits are formed, it is only necessary to repeat the above-mentioned operation.

Figure 20B:
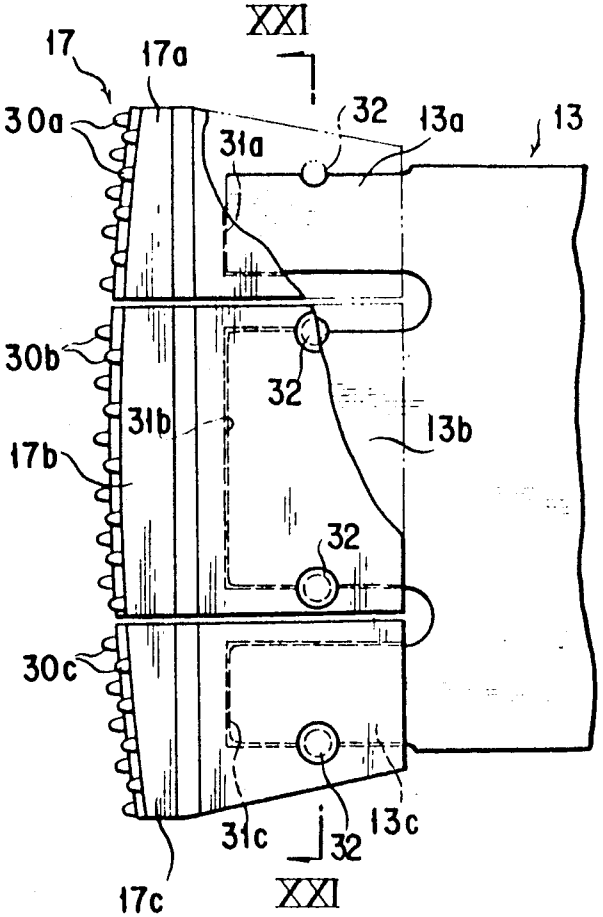
FIGS. 20A and 20B are a front view and a plan view, respectively, showing one embodiment of a plate type bit mounted on the leading end of a plate for use in the apparatus for forming a slit in rock or concrete surface.
Figure 20A:
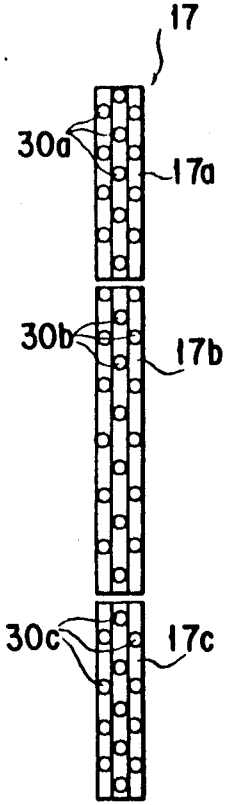

FIGS. 20A, 20B and 20C show another embodiment of the plate type bit 17.

As shown in FIG. 20B, the plate 13 has a right hand tongue 13*a*, a central tongue 13*b* and a left hand tongue 13*c* formed at the leading end portion in juxtaposition.

The plate type bit 17 is comprised of three pieces of bit blocks, i.e. a right hand bit block 17*a*, a central bit block 17*b*, and a left hand bit block 17*c*. These bit blocks 17*a*, 17*b* and 17*c* have mounting holes 31*a*, 31*b* and 31*c* formed in the rear portions thereof, respectively. By fitting the tongues of the plate 13 into their respective mounting holes and connecting them by means of pins 32, each of the bit blocks can be detachably mounted on the leading end of the plate 13.

Further, the bit blocks 17*a*, 17*b* and 17*c* are formed at their respective leading edges with cutting edge portions 30*a*, 30*b* and 30*c*, respectively, each having a plurality of carbide tips.

Thus, the use of the plate type bit 17 comprised of a plurality of bit blocks results in a considerable reduction in maintenance cost due to replacement of parts.

In case, for example, the cutting edge portion 30*a* of the right hand bit 17*a* is partially broken off, it is only necessary to replace the right hand bit block 17*a* while leaving the central and left hand bit blocks 17*b* and 17*c* as they are. Since the size of the right hand bit block 17*a* is about one third of that of the whole plate type bit 17, its manufacturing cost is low as compared with the cost of an integrated type bit, which is not split into several parts.

Figure 21:
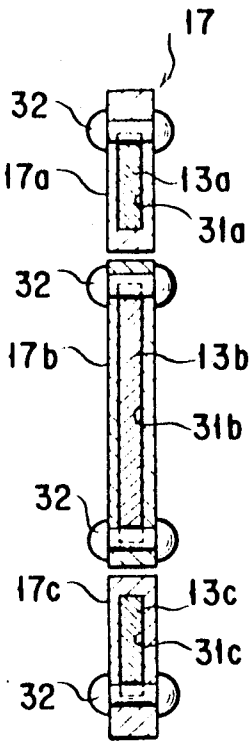
FIG. 21 is a sectional view taken along line XXI—XXI in FIG. 20B.
Figure 22:
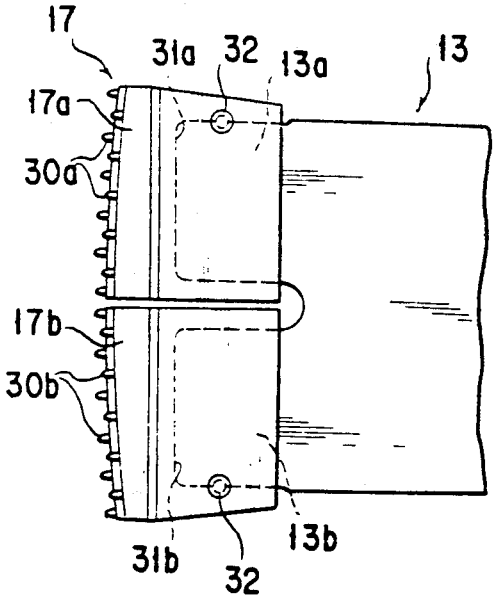
FIG. 22 is a plan view showing another embodiment of the plate type bit mounted on the leading end of the plate.

FIG. 22 shows a modification of the above-mentioned split-type plate-shaped bit 17. Hereupon, the plate-type bit 17 in this modified embodiment comprises two-split bit blocks, i.e. a bit block 13*a* and a bit block 13*b*. Since this embodiment is identical in terms of other arrangements to that shown in FIGS. 20A, 20B and 21, detailed description thereof is omitted herein.

Further, the number of divisions of the bit block is not limited to two and three as in the case of the above-mentioned embodiments and can be set properly so as to meet the requirements, such as the size of the plate type bit, etc.

Further, the cost for replacement of parts can be reduced by using a plurality of bit blocks and also mounting in built-in fashion a plurality of split edge portions (not shown) on the leading end of each of the bit blocks by the bit block group.

The foregoing description is merely illustrative of preferred embodiments of the present invention, and the scope of the present invention is not to be limited thereto. Many other changes and modifications of the present invention will readily occur to those skilled in the art without departing from the scope of the present invention described in the appended claims.

What is claimed is:

1. An apparatus for forming a slit in a rock and a concrete surface comprising: a frame supported in such a manner that it may be turned freely in the vertical direction; a sliding base mounted on the frame in such a manner that it may be slidably moved in the longitudinal direction thereof; a striker means fixedly secured onto the sliding base and having an actuating shaft; a striker plate extending forwardly along said frame and fixedly secured to the leading end of the shaft; two lengths of longitudinally extending rods spaced apart widthwise of said frame and in parallel with each other, each of the rods having one drill bit mounted on the leading end thereof; a first support base fixedly secured to the front end portion of said frame so as to support the portions of these rods near the leading ends thereof such that they may be slidably moved forwardly in the longitudinal direction of said frame; a second rod supporting means fixedly mounted on said sliding base and adapted to slidably support the portions of these rods near the base or trailing ends thereof so as to keep the base ends of said two lengths of rods in contact with the contact surface of said striker plate; a plate having a plate type bit mounted on the leading end thereof, said plate being located in between said two lengths of rods such that the plate type bit is disposed somewhat behind said drill bits when not in use and the base end of the plate is kept into contact with the contact surface of said striker plate; and a plate swinging means for swinging the plate widthwise of said frame.

2. An apparatus for forming a slit in a rock and a concrete surface as claimed in claim 1, characterized in that said plate type bit has cutting edge portions mounted on the leading end thereof.

3. An apparatus for forming a slit in a rock and a concrete surface as claimed in claim 2, characterized in that said plate type bit consists of a plurality of individually detachable bit blocks.

4. An apparatus for forming a slit in a rock and a concrete surface as claimed in claim 1, characterized in that said second rod supporting means comprises two sets of rotating•striking means for striking said two lengths of rods while rotating them about their respective axes.

5. An apparatus for forming a slit in a rock and a concrete surface as claimed in claim 1, characterized in that said plate swinging means comprises a swinging support base mounted on one side of said sliding base and adapted to support said plate so as to slidably move it by a predetermined stroke in the longitudinal direction thereof; and two sets of piston•cylinder units having piston rods capable of extension and contraction and connected between both sides of said swinging support base and both sides of said sliding base so as to swing said plate widthwise of said frame about a fulcrum of swing located substantially at the center of the swinging support base.

6. An apparatus for forming a slit in a rock and a concrete surface as claimed in claim 5, characterized in that the rear end face of said plate and the contact surface of said striking plate which contacts the rear end face are of a circular arc shape whose center is located at the fulcrum of swing of said swinging support base.

7. An apparatus for forming a slit in a rock and a concrete surface as claimed in claim 1, characterized in that said plate swinging means comprises a swinging support base mounted on one side of said sliding base and adapted to support said plate so as to slidably move it by a predetermined stroke in the longitudinal direction thereof; a swing arm whose one side is fixedly secured to the swinging support base and whose other side extends to the approximately intermediate portion of said sliding base; and one set of double-acting piston• cylinder units mounted on the approximately intermediate part of said sliding base and connected to the other side of said swing arm so as to swing said plate widthwise of said frame about the fulcrum of swing located substantially at the center of said swinging support base.

8. An apparatus for forming a slit in a rock and a concrete surface as claimed in claim 7, characterized in that the rear end face of said plate and the contact surface of said striking plate which contacts the rear end face are of a circular arc shape whose center is located at the fulcrum of swing of said swinging support base.

9. An apparatus for forming a slit in a rock and a concrete surface as claimed in claim 1, characterized in that said plate swinging means comprises a first holder adapted to support said plate on the front end side of said frame in such a manner that the plate may be slidably moved in the longitudinal direction thereof; a second holder adapted to support said plate on one side of said sliding base in such a manner that the plate may be slidably moved in the longitudinal direction thereof; a first double-acting piston•cylinder unit fixedly mounted on said frame at a position corresponding to said first holder and connected to both sides of the first holder so as to swing the first holder widthwise of said frame; and a second double-acting piston•cylinder unit fixedly mounted on said sliding base at a position corresponding to said second holder and connected to both sides of the second holder so as to swing the second holder widthwise of said frame.

10. An apparatus for forming a slit in a rock and a concrete surface as claimed in claim 1, characterized in that that it further comprises a stabilizer disposed between the drill bits mounted on the leading ends of said two lengths of longitudinally extending rods, respectively, and said first supporting base, and adapted to support said two lengths of rods in such a manner that they may be slidably moved in the longitudinal direction thereof.

11. An apparatus for forming a slit in a rock and a concrete surface as claimed in claim 10, characterized in that said stabilizer is configured to pass said plate therethrough, and a piece of pin projecting vertically upwards and downwards from the plate is engaged with a hole formed in the central part of the stabilizer so as to connect said plate to said stabilizer so that they may be slidably moved in synchronism with each other.

* * * * *